US010631662B2

(12) United States Patent
Stachowski

(10) Patent No.: US 10,631,662 B2
(45) Date of Patent: Apr. 28, 2020

(54) CHILD SEAT

(71) Applicant: Breanna L Stachowski, Elma, NY (US)

(72) Inventor: Breanna L Stachowski, Elma, NY (US)

( * ) Notice: Subject to any disclaimer, the term of this patent is extended or adjusted under 35 U.S.C. 154(b) by 193 days.

(21) Appl. No.: 14/549,884

(22) Filed: Nov. 21, 2014

(65) Prior Publication Data

US 2019/0365118 A1 Dec. 5, 2019

Related U.S. Application Data

(60) Provisional application No. 61/907,794, filed on Nov. 22, 2013, provisional application No. 61/916,377, filed on Dec. 16, 2013.

(51) Int. Cl.
*A47D 1/00* (2006.01)
*A47D 1/10* (2006.01)

(52) U.S. Cl.
CPC ..... *A47D 1/004* (2013.01); *A47D 1/00* (2013.01); *A47D 1/10* (2013.01)

(58) Field of Classification Search
CPC ..... A47D 1/004; A47D 1/10
USPC ..... 297/250.1, 219.12, 256.16, 256.11
See application file for complete search history.

(56) References Cited

U.S. PATENT DOCUMENTS 4,322,110 A 3/1982 Simmons et al.
4,854,638 A 8/1989 Marcus et al.
6,033,019 A * 3/2000 Hession-Kunz ..... A47D 1/002 297/250.1 X
6,224,148 B1 5/2001 Lee et al.
6,676,213 B1 * 1/2004 Dlugos ..... B60N 2/2866 297/256.11 X
7,032,970 B1 4/2006 Kharat
7,591,506 B2 9/2009 Flannery
7,673,934 B2 3/2010 Bearup et al.
7,918,497 B2 4/2011 Keegan
8,226,161 B2 7/2012 Fiore et al.
8,240,762 B2 * 8/2012 Herzberg ..... B60N 2/01 297/256.16 X
8,567,867 B2 10/2013 Arnold et al.
8,678,491 B2 3/2014 Chen et al.
8,764,109 B2 7/2014 Kummerfeld et al.
(Continued)

OTHER PUBLICATIONS

Fisher-Price Healthy Care Deluxe Booster Seat: http://www.fisher-price.com/en_US/brands/babygear/products/46520; printed on Feb. 22, 2014.

(Continued)

*Primary Examiner* — Anthony D Barfield
(74) *Attorney, Agent, or Firm* — Notre Dame Intellectual Property Clinic

(57) ABSTRACT

An improved child seat allows for easier cleaning and adaptation to suit children of various sizes and ages. The child seat can include features such as a removable seat pan that has upwardly curved edges to keep debris inside the seat pan and which allows for easy clean up. The seat pan can be removed to enlarge the chair for a growing child to fit inside the child seat. For additional flexibility, the child seat can incorporate a height adjustment mechanism to support the seat and match the stature of the child. This height adjustment mechanism can also be used to clamp the child seat to a tabletop.

13 Claims, 12 Drawing Sheets

(56) References Cited

U.S. PATENT DOCUMENTS

2014/0125099 A1 5/2014 Williams et al.

OTHER PUBLICATIONS

Bumbo Floor Seat with Bonus Play Tray: http://www.walmart.com/ip/Bumbo-Floor-Seat-with-Bonus-Play-Tray-Bundle/22153753; printed on Feb. 22, 2014.
Fisher-Price SpaceSaver High Chair: http://www.fisher-price.com/en_US/brands/babygear/products/65290; printed on Feb. 22, 2014.
Inglesina Fast Table Chair: http://www.inglesina.us/fast-table-chair.html; printed on Feb. 22, 2014.
Chicco 360 Hook on Miro: http://www.chiccousa.com/gear/highchairs-hookons/360-hook-on/360-hook-on-miro.aspx; printed on Feb. 22, 2014.
Fisher-Price Home & Away 3-in-1 High Chair: http://www.toysrus.com/buy/high-chairs/fisher-price-home-away-3-in-1-high-chair-x2534-29311166; printed on Jun. 16, 2015.
Fisher-Price EZ Clean High Chair: http://www.amazon.com/Fisher-Price-Clean-Sorbet-Discontinued-Manufacturer/dp/B004C43JJO; printed on Jun. 16, 2015.

* cited by examiner

CHILD SEAT

CROSS REFERENCE TO RELATED APPLICATIONS

This application claims the benefit of U.S. provisional applications No. 61/907,794 Child Seat, filed Nov. 22, 2013 and No. 61/916,377 Child Seat, filed Dec. 16, 2013, both of which are incorporated herein by reference.

TECHNICAL FIELD

The apparatuses and methods described herein relate to the field of chairs and seats and more particularly to seats for infants and toddlers, such as child seats or booster seats.

BACKGROUND

Many of the current chairs designed for children are bulky and awkward, using a large amount of materials. Parents and other care-givers often need to buy several different types of chairs, including various spacing saving and stand-alone high chairs, booster seats, and table attachment chairs for daily use. It can be expensive for parents who buy multiple chairs for different uses in different locations; whether having toddlers at the table during dinner time, on the floor during play time, or elsewhere.

Cleaning up after a child's meal can be messy, especially during a toddler's early development when they are learning to eat, and learning to feed themselves. Frequently, high chairs do not meet the demands of busy parents. Food gets lodged in cracks, and harness straps and cushions are easily stained as well as being hard to remove and clean. Large gaps between the high chair and table can result in food slipping and falling onto nearby surfaces, including tables, chairs and the floor.

In addition, parents frequently buy multiple designs and models of children's seats due to the continuing demands of growing children. Young infants have different developmental needs from older toddlers. Usually, infants between four to five months are supported sitters who can sit up only with help. In general, around six to seven months, infants start to gain the ability to sit independently. Around eight to eleven months, infants gain the ability to stand and feed themselves. And, by the time they are two-years old, children develop the ability sit in boosters and child seats on their own. Many of the currently available chairs or devices meant for a five-month old child are too small and constraining for a two-year old child. In addition, younger infants require chairs that are rigid and tailored to their size to provide the necessary support. The close fit of the child in the chair decreases the potential spillage of food while acting as an extra safety measure by limiting movement of squirmy children and preventing slips and falls. But, older toddlers may find these same chairs too constraining and uncomfortable. As a result, older chairs may be abandoned for newer, larger designs which can prove costly.

BRIEF SUMMARY

The following presents a simplified summary in order to provide a basic understanding of some aspects of the claimed subject matter. This summary is not an extensive overview. It is not intended to either identify key or critical elements or to delineate the scope of the claimed subject matter. Its sole purpose is to present some concepts in a simplified form as a prelude to the more detailed description that is presented later.

The described child seat provides a more efficient and convenient way to seat children, particularly when dining, but is not limited to use at a table or at meal times. The child seat functions as a multipurpose chair, in lieu of the standard high chair or booster seat, and can be adapted to the different needs of growing children in different embodiments. It can also be adapted to the many stages of the growth and feeding development of an infant into early childhood. The child seat facilitates these adaptions through removable attachments and a height adjustment mechanism, which allows for versatility.

In its different embodiments, the child seat also provides varying levels of support depending on the development and needs of the child. Different aspects of the device such as the seat pan, height adjustment mechanism, and tray vary the seating area of the chair to fit the different needs and ages of the child. As a result, the child seat can be used throughout the growth of a child from approximately four months of age to two years or more. In addition, variations of the child seat can be easily transported and adapted to provide safety, convenience, and cleanliness. The child seat is lightweight and can be moved to different rooms of a home or brought to external locations like restaurants.

In certain aspects, the child seat is versatile, includes different removable components, and facilitates faster and more efficient cleaning. All or part of the child seat can be formed from a washable material that only requires the wipe of a sponge to clean. In some embodiments, several of the attachable features include the seat pan, tray, and restraint belts can also be removed to be washed in the sink or in the dishwasher to assist in the ease of cleaning. Particularly, the removable seat pan allows for easy clean-up of spilled substances.

Embodiments of the child seat may be placed on the floor, on a table, or on a chair. This all-in-one chair can be used for dining, sitting, and playing. For example, in an aspect the device is placed on the floor and after an informal meal allows for easy clean-up. Alternatively, the child seat can be attached to a table top, where the device placed on the top surface of the table and secured using a clamping mechanism. In this embodiment, placement on the table top makes it easier for parents to assist toddlers when dining as well as creating a more intimate family experience. In another embodiment, the device is placed on a chair and secured with straps to the top of the chair.

The application discloses a child seat, comprising a seat component which includes a back support, arms, and a seat bottom. The seat component is shaped to support a child in a sitting position. A removable seat pan rests on top of the seat bottom and is complementary in shape to the seat bottom. Another embodiment disclosed is a child seat, comprising a seat component shaped to support a child in a sitting position, including a back support, and arms, and a seat bottom. The child seat includes a height adjustment mechanism connected to and supporting the seat component and a base component connected to the height adjustment mechanism. Together, the seat component, height adjust mechanism and base portion form a clamp capable of securing the seat to a table. The seat bottom rests on the surface of the table with the base portion positioned below table surface and the height adjustment mechanism is configurable to table top width providing a clamping force. Yet another embodiment disclosed is a child seat comprising a seat component shaped to support a child in a sitting position, including a back support, arms, and a seat bottom, a removable seat pan shaped to fit within the seat bottom; a height adjustment mechanism connected to and supporting the seat component; a base component connected to the height adjustment mechanism. Together, the seat component, height adjust mechanism and base portion form a clamp capable of securing the seat on the table. The seat component is positioned to be resting on the table surface with base portion below table surface and the height adjustment mechanisms adapts to table top width providing a clamping force.

To accomplish these and other ends, some aspects of the claimed subject matter are illustrated in the description and the attached drawings. These aspects describe some ways the claimed invention could be practiced, but other advantages and novel features may be revealed when the detailed description is considered with the drawings.

BRIEF DESCRIPTION OF THE DRAWINGS

The systems, devices, and methods may be better understood by referring to the following description in conjunction with the accompanying drawings, in which like numerals indicate like structural elements and features in various figures. The components in the figures are not necessarily to scale, and simply illustrate the principles of the systems, devices, and methods. The accompanying drawings illustrate only possible embodiments of the systems, devices, and methods and are therefore not to be considered limiting in scope.

DETAILED DESCRIPTION

Figure 1:
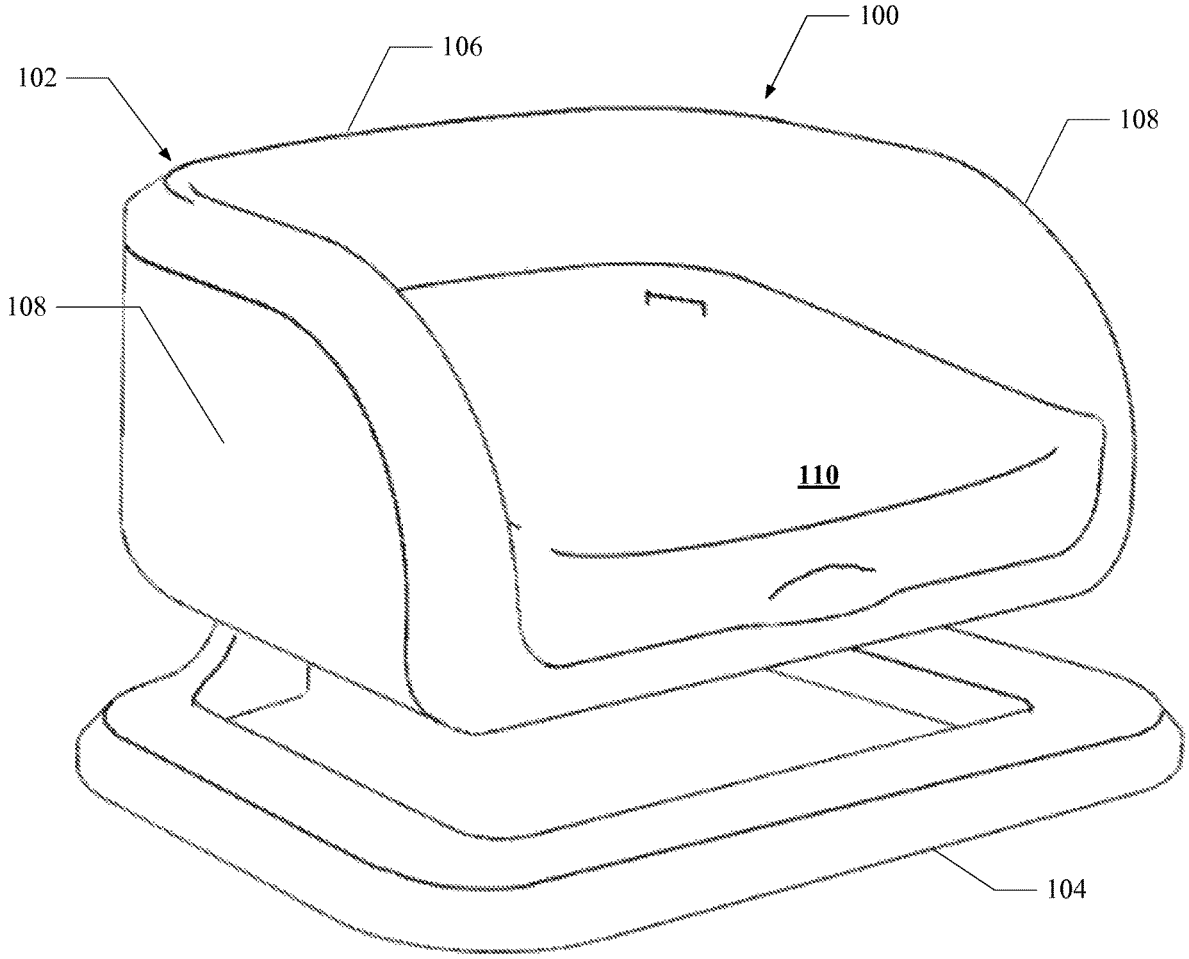
FIG. 1 is a perspective view of an embodiment of a child seat.

Aspects of the system and methods are described below with reference to illustrative embodiments. The references to illustrative embodiments below are not made to limit the scope of the claimed subject matter. Instead, illustrative embodiments are used to aid in the description of various aspects of the systems and methods. The description, made by way of example and reference to illustrative reference is not meant to being limiting as regards any aspect of the claimed subject matter. The description provides for developing and operating a child seat in connection with the device illustrated in the drawings. It is to be understood that the same or equivalent functions may be accomplished with different embodiments within the scope of this description. It is further understood that the use of relational terms are for descriptive purposes and do not require any actual relationship or order between such entities.

The standard child seat contains many crevasses and slots that make it difficult for parents to clean. As a child is learning to eat, he is prone to make his hands, face, and eating areas very messy. Food appears to be drawn, almost as if by a magnetic force, to the crevasses and slots of the child seat, becoming embedded in the seat and resisting clean-up efforts. In addition, the majority of the currently available chairs are bulky or suited to only one purpose, which is inconvenient for the busy parent. A one size fits all device is unsuitable for the needs of many parents whose toddlers are growing rapidly. Various embodiments of the child seats described herein can be used to reduce or eliminate these problems.

Turning now to the drawings, FIG. 1 illustrates an embodiment of a child seat 100 that facilitates efficient and convenient clean up after a child's meal. The depicted child seat 100 includes a seat component 102 formed for a small child. The seat component 102 is the portion of the child seat 100 that directly supports the child. The seat component 102 is supported by a base component 104. As shown, in embodiments, the seat component 102 includes a seat bottom 501, a back support 106, and arms 108, appropriately sized for a small child. The seat component 102 is suitable for supporting a child on the seat bottom 501, the back support 106 and arms 108 serving both to assist the child in maintaining a comfortable sitting position, while preventing the child from sliding out or off the seat component 102.

The base component 104 holds the seat component 102 at a comfortable height above a supporting surface, whether a table, a chair, the floor, or any other surface on which the child seat 100 is placed. In embodiments, the base component 104 is connected to the seat component 102 near or at the back of the chair. The gap between the seat component 102 and the base component 104 is aesthetically pleasing and can be used to secure the child seat 100 to a table, as described below. In other embodiments, the base component 104 can be connected to the seat component 102 at multiple points, or the seat component 102 can sit directly on a surface without the base component 104.

In an embodiment, the child seat 100 includes a seat pan 110. As shown, the seat pan 110 can be shaped to fit seamlessly or virtually seamlessly on or in the seat component 102. In embodiments, the smooth transition between the seat pan 110 and the seat component 102 reduces the potential for solid or liquid debris to become embedded in seams or crevasses of the child seat 100. As used herein, the term "debris" includes solids and liquids, crumbs, spills and any other mess or detritus. In the illustrated embodiment, the seat pan 110 is curved upward on one or more of the edges along the back of the seat component 102, near the back support 106 and arms 108, such that debris is caught and held on the seat pan 110.

In embodiments, the seat pan 110 is removable to facilitate cleaning of the child seat 100. The top surface of the seat pan 110 can be substantially concave and facilitates retaining the debris within the seat pan 110 until the contents are safely deposited in a sink or trashcan or otherwise disposed of. It is not necessary that the entirety of the seat pan is concave, but the edges need to be curved upwards in order to retain the debris. Many of the components of the depicted child seat 100 can also be removed and washed in the sink, dishwasher, or washing machine to facilitate cleaning.

In embodiments, the seat pan 110 is formed from a rigid or semi-rigid material. This can be plastic, metal, or any other material that allows the seat pan 110 to keep its shape and generally horizontal orientation when lifted out of the child seat 100. This rigidity keeps the debris from falling off the seat pan 110 before the parent reaches the sink or trash. The concave form and rigidity help prevent the common spills that occur when lifting a plastic sheet, or fabric cover. The rigidity allows the removal of the seat pan 110 with one hand, leaving the other hand free to hold the child, grab a towel, wipe down the table, or perform any of the other hundred potential tasks.

In embodiments, at least a portion of the child seat 100 is formed from washable material that is easy to clean. In one embodiment, one or more components of the child seat 100 can be made from injection molded high density organic polymer, including but not limited to polyethylene, polypropylene, acrylonitrile butadiene styrene (ABS), and polycarbonate plastic to provide a safe surface on which the child may sit and eat. In embodiments, weights are added to the base component 104 of the child seat 100 to keep the center of gravity of the child seat 100 low and to prevent tipping, thereby enhancing the safety of the child seat 100. In embodiments, the weights are comprised of steel, lead, or any other high-density material. The weights can be incorporated into the material of the base component 104. In other embodiments, the weights can be removable.

Figure 2:
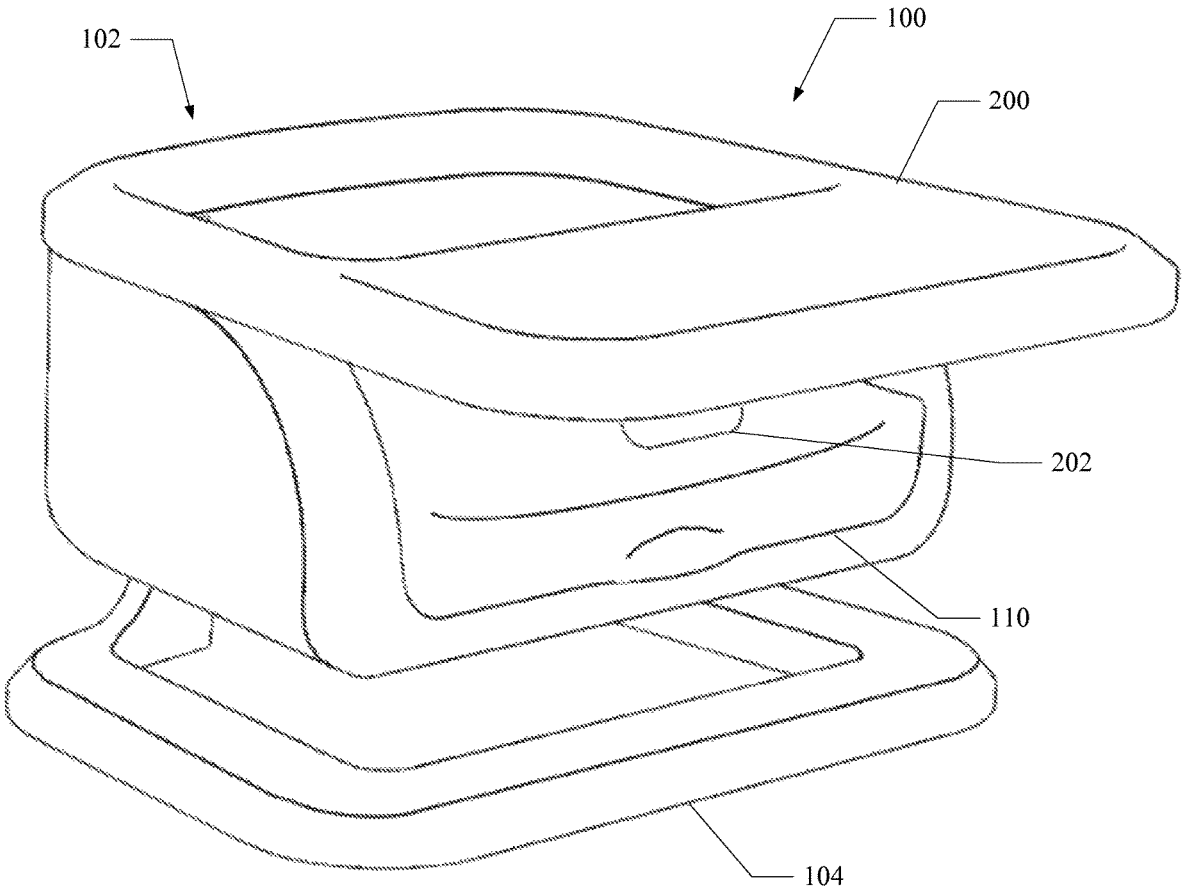
FIG. 2 is a perspective view of an embodiment of the child seat including a tray.

Turning now to FIG. 2, an embodiment of the child seat 100 including a tray 200 positioned on the top of the seat component 102 is depicted. The tray 200 provides a surface on which to place the food for the child and also minimizes dropping or spilling debris on other areas such as the floor, the child, the child seat 100, a table, or any other nearby surfaces. In some embodiments, the tray 200 is removable for cleaning or to facilitate inserting or removing the child from the child seat 100. In the depicted embodiment, the tray 200 is shaped to sit on top of the back support 106 and arms 108, extending in front of the seat component 102, providing a flat surface, and including a lip to prevent food, liquids and debris from spilling off the tray 200.

As shown, the tray 200 can include a restraining bar 202, sometimes called a T-bar, which is a projection extending downward from the tray 200 and generally centered in front of the seat component 102. The restraining bar 202 can be of any size or shape useful in retaining the child in the seat component 102, while allowing the child's legs to extend below the tray 200 from the seat component 102. As shown, the restraining bar 202 is generally rectangular in shape and sized to leave a minimal gap between the tray 200 and the seat pan 110. The restraining bar 202 helps to secure the child in the seat component 102 and prevents the child from sliding between the seat component 102 and tray 200 and slipping out of the child seat 100. When the child is seated in the child chair, the child's legs extend on either side of the restraining bar 202, dangling freely, while the restraining bar 202 holds the child in place.

Figure 3A:
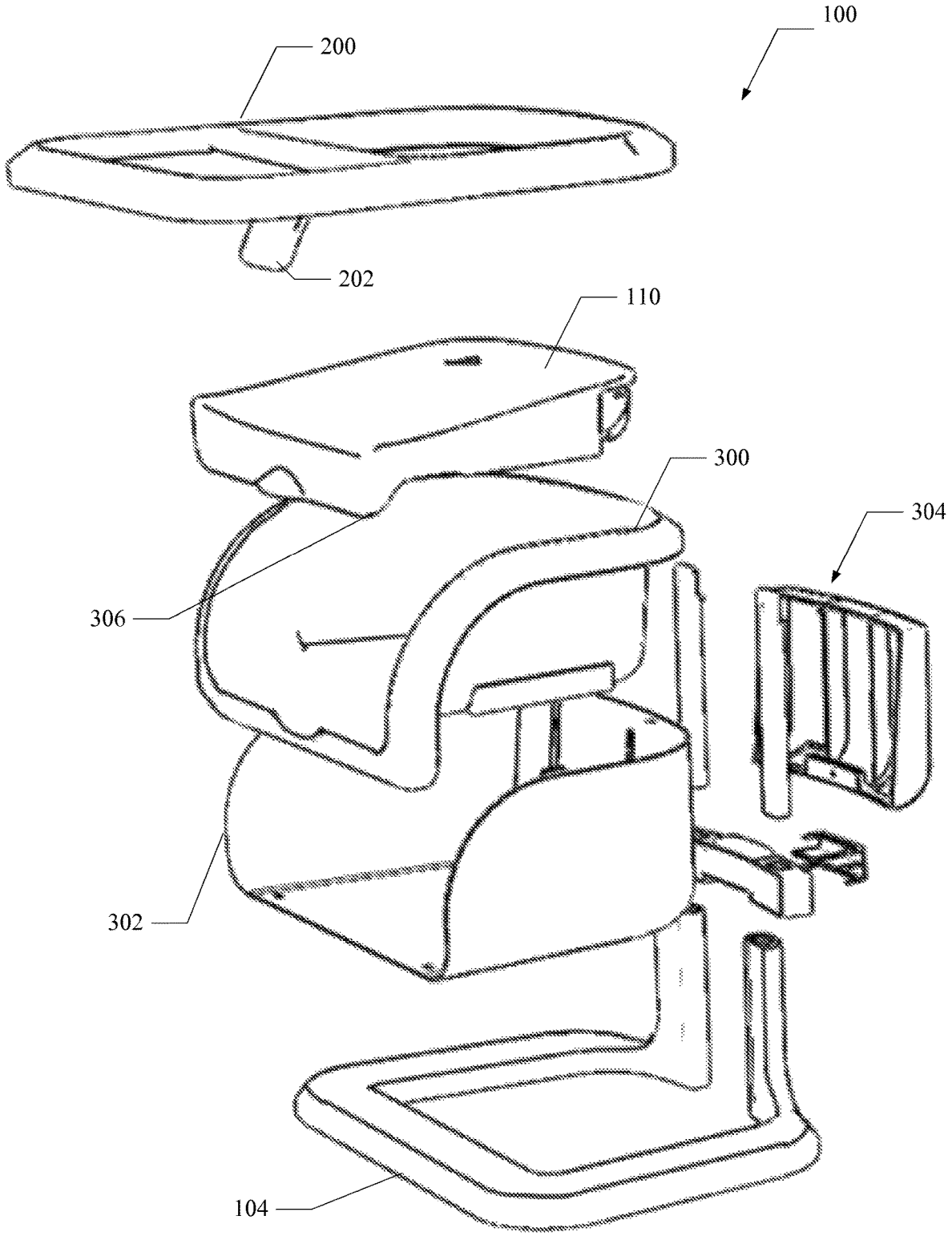
FIG. 3A is an exploded, front perspective view of an embodiment of a child seat.
Figure 3B:
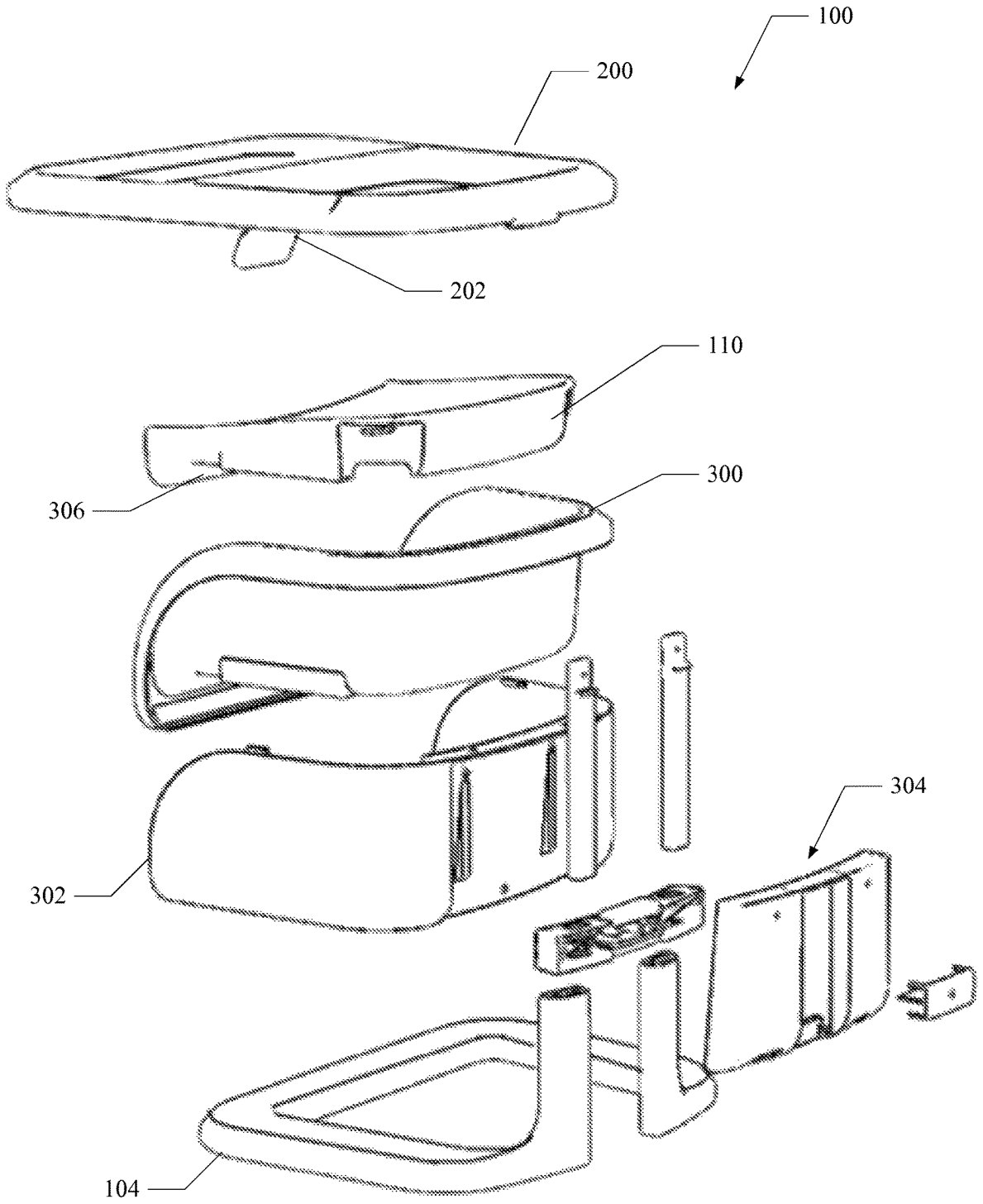
FIG. 3B is an exploded, rear perspective view of an embodiment of a child seat.

FIGS. 3A and 3B are exploded views illustrating an embodiment of the child seat 100 including the seat component 102, formed from an inner shell 300 and outer shell 302, and the base component 104. The inner shell 300 and outer shell 302 combine to form the seat component 102 on which a child may sit. Combined, the inner shell 300 and outer shell 302 also provide a back portion 106 to support a child's back and arms to keep a child in place as well as serving as arm rests 108. In the illustrated embodiment, the inner shell 300 includes a lip or edge, such that when the inner shell 300 and outer shell 302 are assembled, the seam between the inner shell 300 and outer shell 302 is protected and positioned to reduce the potential for debris to be caught in the seam. In embodiments, the seams, creases, cracks or crevasses within the child seat 100 are minimized, facilitating clean up and such that a simple wipe down of the seat component 102 is sufficient to clean the child seat 100. These potential food traps are reduced by constructing the device of a minimum number of pieces and arranging any seams, holes, or the like on the underside of the child seat 100. The inner shell 300 can be attached to the outer shell 302 through screws, adhesives, tabs or any other suitable manner of connecting. In other embodiments, the seat component 102 can be formed as a single, monolithic part rather than incorporating a separate inner shell 300 and outer shell 302.

In other embodiments, described in further detail below with respect to FIGS. 4, 5 and 9, a tray 200 and a seat pan 110 can be attached or removed from the seat component 102 depending on the needs and uses of the child. For example, the child seat 100 can be used with both the tray 200 and the seat pan 110 for infants or toddlers to support the child, raise the height of the child when seated and minimize mess. As the child grows, the child seat 100 can be used without the tray 200, serving as a booster seat. The height of the child seat 100 can be adjusted via a height adjustment mechanism 304 and the seat pan 110 can be inserted or removed as needed to adjust the height for the size of the individual child. Consequently, the child seat 100 is customizable to the needs and size of the individual child and can grow and change with the child.

The base component 104 serves to support the seat component 102 and keeps the child seat 100 in place. In the illustrated embodiment, the dimensions of the base component 104 are approximately the same in width and depth as the seat component 102. In one embodiment, the base is 14.5 inches long and 11.3 inches wide. Typically, the base component 104 is of sufficient width, depth and weight to ensure stability of the child seat 100 even when occupied by a squirming child. As shown, the base component 104 can include a horizontal portion or footing, including one or more apertures or openings, reducing material costs. In other embodiments, the base component 104 is a solid, continuous piece. In aspects, the base component 104 includes vertical supports that bear the height adjustment mechanism 304 and the weight of the seat component 102.

In embodiments, the seat component 102 is connected to the base component 104 proximate to the back support 106 and can be raised or lowered by a height adjustment mechanism 304 to varying heights, allowing for use with children of varying sizes. The height adjustment mechanism 304 allows the child seat 100 to be customized for a child. In an embodiment, the height adjustment mechanism 304 includes a fixed number of predetermined heights or positions. For example, this can be accomplished using one or more telescoping tubes to support the seat component 102. In an embodiment, a tube or support includes a series of apertures along the length of the tube. A simple spring-based pin in a nested tube can be inserted through a selected aperture to lock the nested tubes at a predetermined length. In other embodiments, the height adjustment mechanism 304 can be continuous as shown below in more detail in FIGS. 6A and 6B.

The adjustable distance between the seat component 102 and the base component 104 can be customized for the height and size of the child as well as the manner in which the child seat 100 is used. In an embodiment, the distance between the base component 104 and the seat component 102 can be adjusted to act as a clamp to attach the child seat 100 to a table by resting the seat component 102 on the surface of table and sliding the base component 104 beneath the table top. The child seat 100 can be secured by reducing the distance between the base component 104 and seat component 102, clamping the child seat 100 to the table. Alternatively, the child seat 100 can be used with a typical chair or on the floor by setting the base component 104 onto the chair or floor surface. The flexibility in design allows for adjustment of the child seat 100 to the needs of parent and child.

Figure 4:
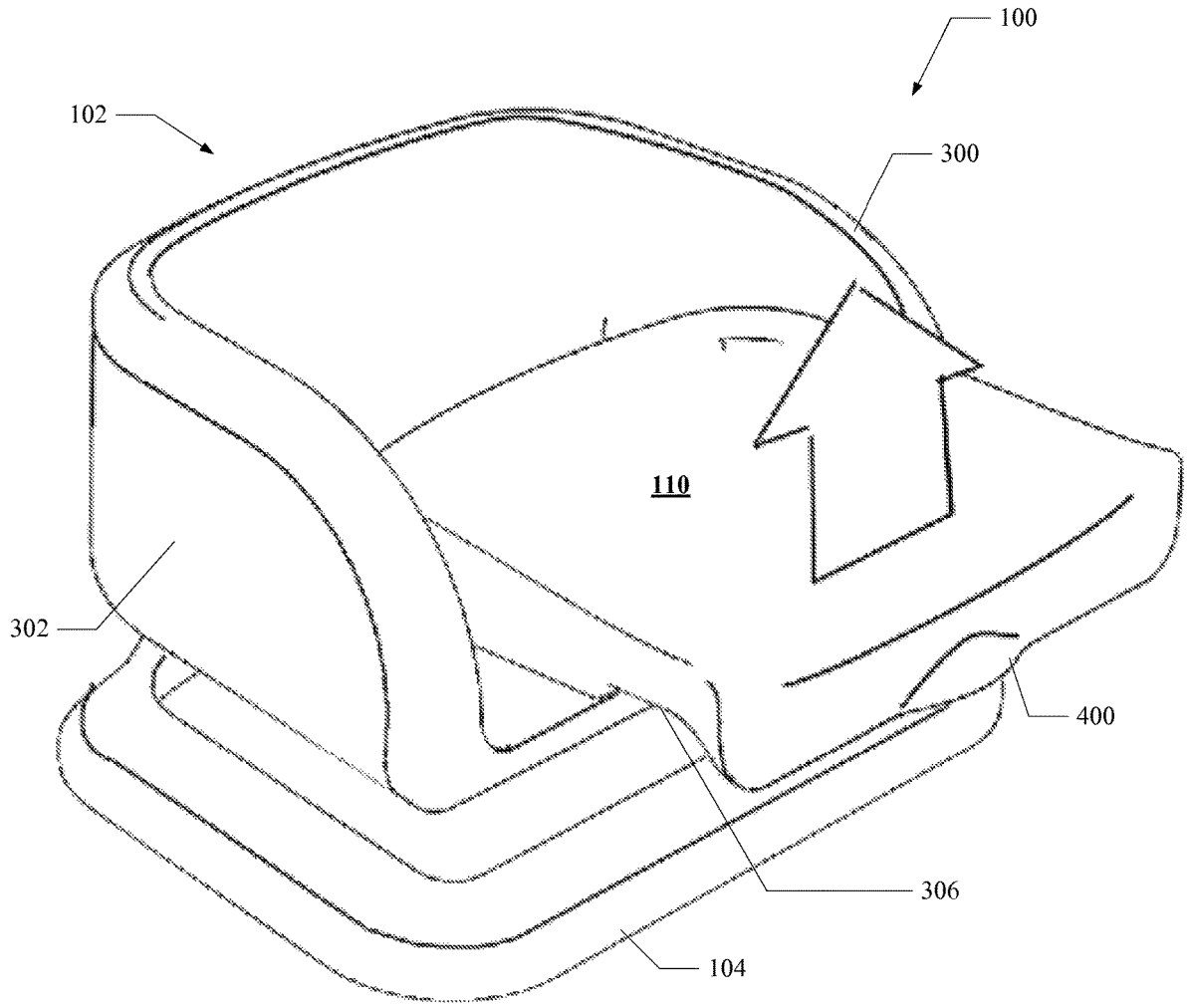
FIG. 4 is a perspective view of an embodiment of a child seat featuring the seat pan as it is being removed.
Figure 5:
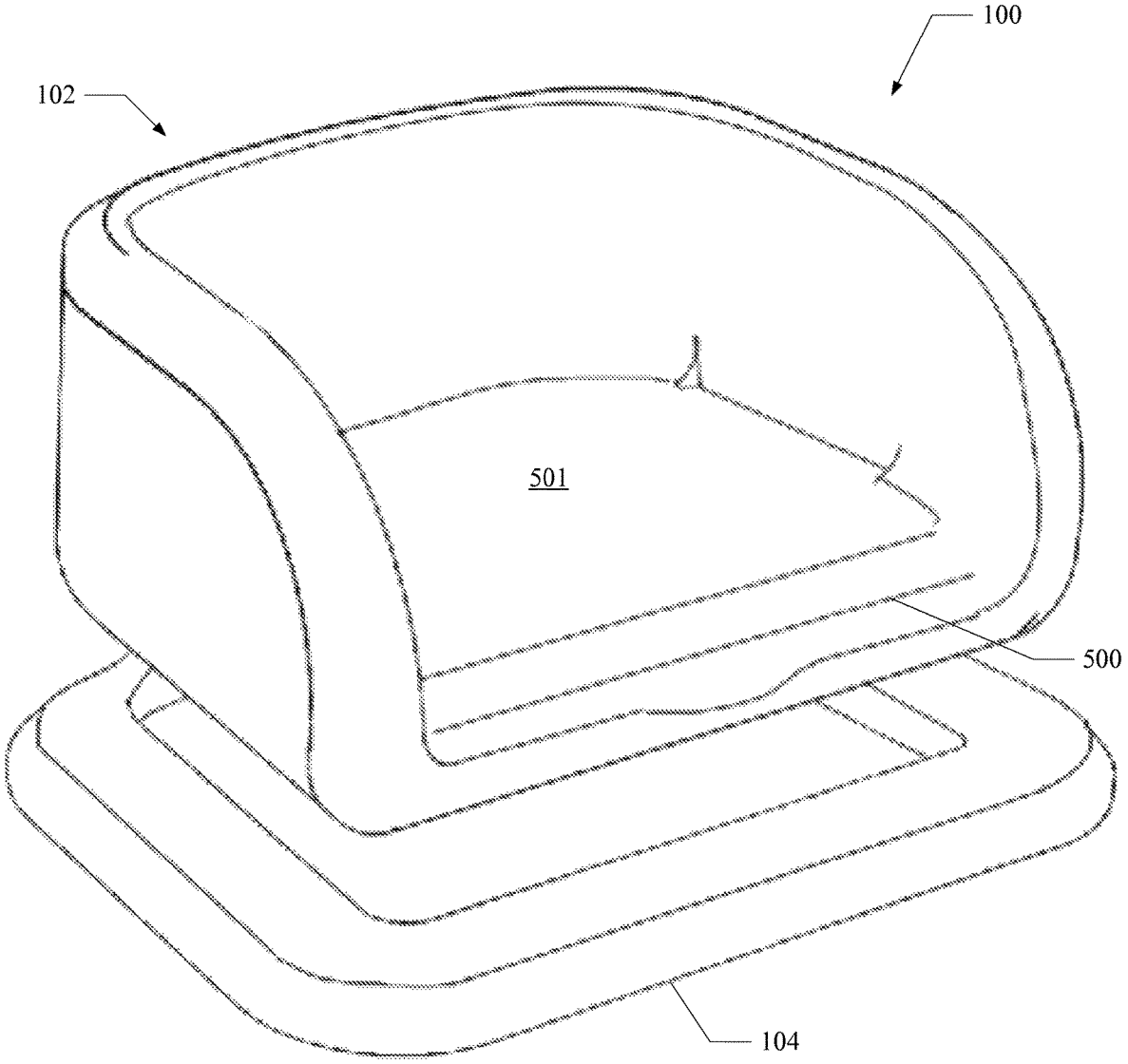
FIG. 5 is a perspective view of an embodiment of a child seat with a seat pan removed.

FIGS. 4 and 5 illustrate the removable nature of an embodiment of the seat pan 110. Here, the seat pan 110 acts as an extra layer of defense against messy eaters by catching any crumbs, spills, leftover snacks or other debris that usually would fall or spill onto other areas such as the floor, table, seat component 102 of the child seat 100, etc. As mentioned above, the seat pan 110 can be shaped to curve upwards on the outer edges when seated within the inner shell 300. This configuration increases the likelihood that any crumbs or other spillage will be retained within the seat pan 110. The minimal cracks and crevasses of this embodiment, along with its washable material, make for easy clean-up with a towel or wash cloth. Furthermore, the seat pan 110 can include a hand grasp 400 at the front that allows it to be easily grasped and carried. The crumbs, spills or other debris can be brushed from the seat pan 110 straight into the trash or the sink. The shape of the seat pan 110 reduces the potential for debris to spill from the seat pan 110 enroute from the child chair to the trash or sink. In some embodiments, the seat pan 110 can be washed in the sink or in the dishwasher to facilitate cleaning.

As depicted in FIG. 5, the seat pan 110 can be formed to sit securely within the inner shell 300, and lifted out for cleaning. In an embodiment, the seat pan 110 includes a groove 306, notch, or indented portion on the underside of the seat pan 110. A ridge 500 in the inner shell 300 mates with a groove 306 on the seat pan 110 to hold the seat pan 110 in place relative to the inner shell 300 and preventing a child from simply sliding the seat pan 110 forward out of the inner shell 300 and seat component 102. While the groove 306 and ridge 500 depicted hold the seat pan 110 in place, numerous other configurations would serve to secure the seat pan 110. For example, the seat pan 110 could include a ridge or protrusion, while the seat bottom 501 or inner shell 300 could include a complementary groove or indentation. The seat pan 110 can be disengaged from the inner shell 300 by simply lifting the seat pan 110, a difficult maneuver for a child seated within the child seat 100, but easily accomplished by a parent cleaning the seat component 102. In other embodiments, the seat pan 110 includes a locking mechanism with push button release.

Thus, FIG. 5, illustrates the child seat 100 where the seat pan 110 and tray 200 have been removed for cleaning or to allow for a larger sitting area and enable use by older children who may find the seat pan 110 and tray 200 too constraining, either while dining or generally, as a chair. The same benefit of the height adjustment mechanism 304 and minimal cracks and crevasses applies, when compared with FIG. 4. Additionally, FIG. 5 depicts the ridge 500 in the inner shell 300 that assists in securing the seat pan 110 in place. This same ridge 500 can also assist in preventing the child from simply sliding out of the seat component 102.

Figure 6A:
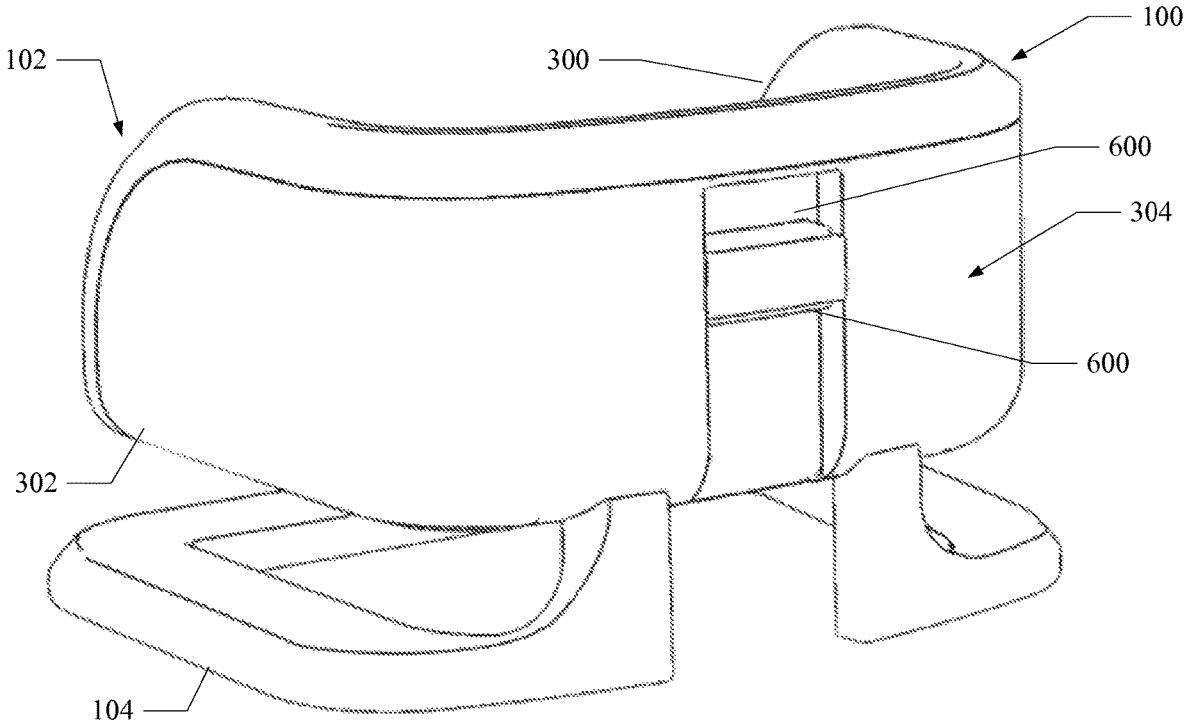
FIG. 6A is a rear, perspective view of an embodiment of a child seat, including a height adjustment mechanism.

FIG. 6A depicts an embodiment of the child seat 100 with a height adjustment mechanism 304 that adjusts the height of the seat component 102 relative to the base component 104. The height adjustment mechanism 304 increases the versatility of the child seat 100 and expands both the environments in which it can be used and the sizes of children that can use it. When buttons 600 are pressed, a slider is unlocked, thereby allowing users to adjust the height of the child seat 100 freely.

In an embodiment, shown in FIG. 6A, the height adjustment is continuous, allowing the user to select a height anywhere along the length of the height adjustment mechanism 304. When the buttons 600 are released, the height adjustment mechanism 304 is locked in place. The child seat 100 can be adapted to the different ages and sizes of children, and for different situations because of this ability to adjust the height of the seat component 102 relative to the base component 104 of the child seat 100.

In one embodiment, the height adjustment mechanism 304 is positioned on or adjacent to the back of the outer shell 302, proximate to the back support 106, making it more difficult for a child to reach or operate when seated in the seat component 102. In other embodiments, the height adjustment mechanism 304 is located on one or both of the sides of the seat component 102. In yet others, it is positioned centrally below the seat component. As illustrated, the outer shell 302 can be formed to hide or protect all or part of the mechanics of the height adjustment mechanism 304, reducing the potential for fingers, hair, or anything else to be caught or pinched by the mechanism 304.

Figure 6B:
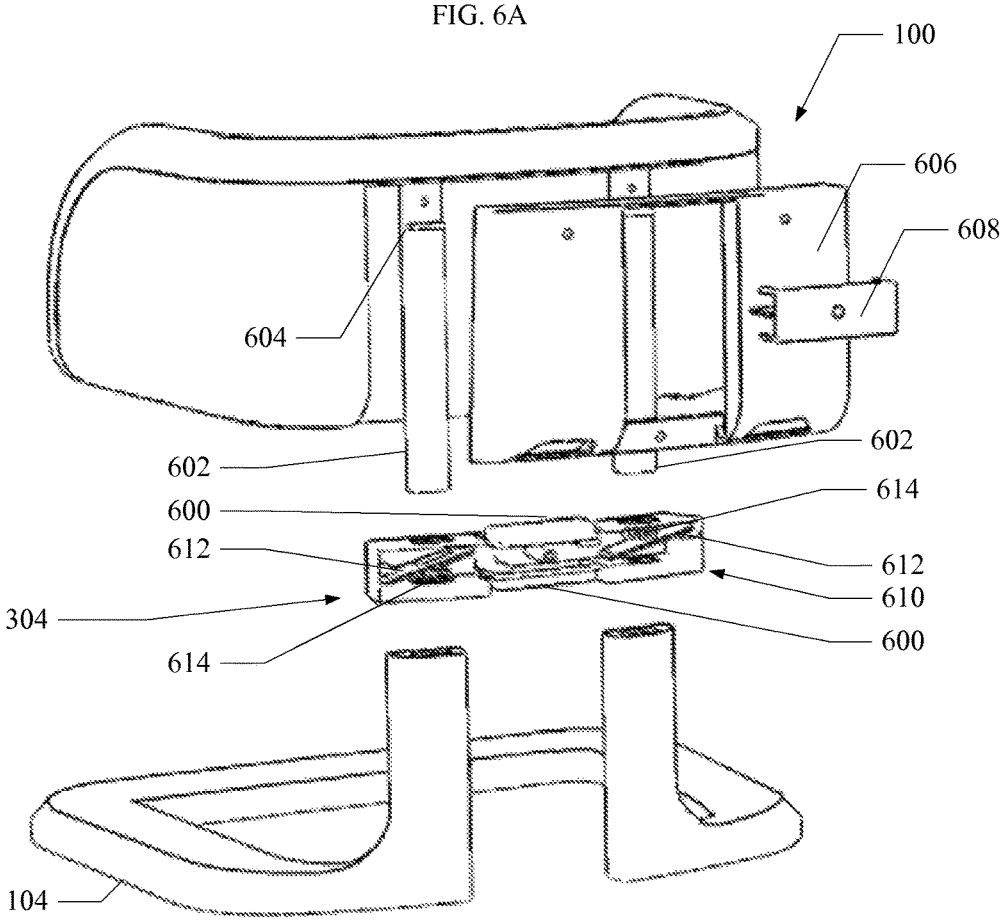
FIG. 6B is an exploded, rear, perspective view of an embodiment of a child seat, including a height adjustment mechanism.

In an embodiment illustrated in FIG. 6B, the components of the height adjustment mechanism 304 include two sliding bars 602 that extend up from the base component 104 and enable the seat component 102 to slide along a predetermined length to move the seat component 102 up or down. In one embodiment, the sliding bars 602 can be made from die cast steel, aluminum, other metals, or polymers. In other embodiments, the sliding bars 602 also contain stops 604 that prevent motion past a certain point. For example, the stops 604 on sliding bars 602 can prevent the seat component 102 from being lifted completely off sliding bars 602 and base component 104. In embodiments, the height adjustment mechanism 304 contains a mechanism pan 606 that protects the mechanics of the height adjustment mechanism 304, keeping out debris that could cause it to jam, and reducing the potential for injuries. The illustrated embodiment also includes two buttons 600 that unlock the height adjustment mechanism 304 when pressed, allowing the height adjustment, as well as a slider pan 608 that keeps the buttons 600 in place. In this embodiment, a mechanism case 610 attaches to the seat component 102, lock bars 612, and two springs 614 secure the seat component 102 at a fixed height.

In embodiments, the mechanism 304 comprises a two button activated locking apparatus, which unlocks when both buttons 600 are pressed at the same time, and remains locked in place when one or both of the buttons 600 are released. The use of a pair of buttons 600 decreases the potential for an accidental release of the lock. When locked, the seat component 102 remains fixed in position relative to the base component 104. In particular, when the two buttons 600 of the locking mechanism are simultaneously pressed, a spring loaded lock bar 612 is released, allowing the top portion of the chair to slide freely up and down. When the buttons 600 are released, the springs 614 reengage and force the lock bar 612 against the sliding bars 602, fixing the position of the seat component 102. The angle of this interaction between the lock bars 612 and the sliding bars 602 prevents any further motion from occurring.

In some embodiments, the mechanism 304 is continuously sliding, meaning there are no ledges or notches defining potential height of the seat component 102 relative to the base component 104. Thus, there are no preset heights for the mechanism 304, which allows parents greater flexibility when using this device. In the illustrated embodiment, the mechanism 304 allows for the seat component 102 to be raised or lowered within a three inch range. In other embodiments, the height adjustment mechanism 304 is adjustable in a range greater than three inches or less than three inches. Furthermore, in some embodiments, the continuous nature of the height adjustment allows the child seat 100 to be more securely clamped to the table than would be possible using a height adjustment mechanism 304 that was capable of only preset, discrete heights.

Figure 7:
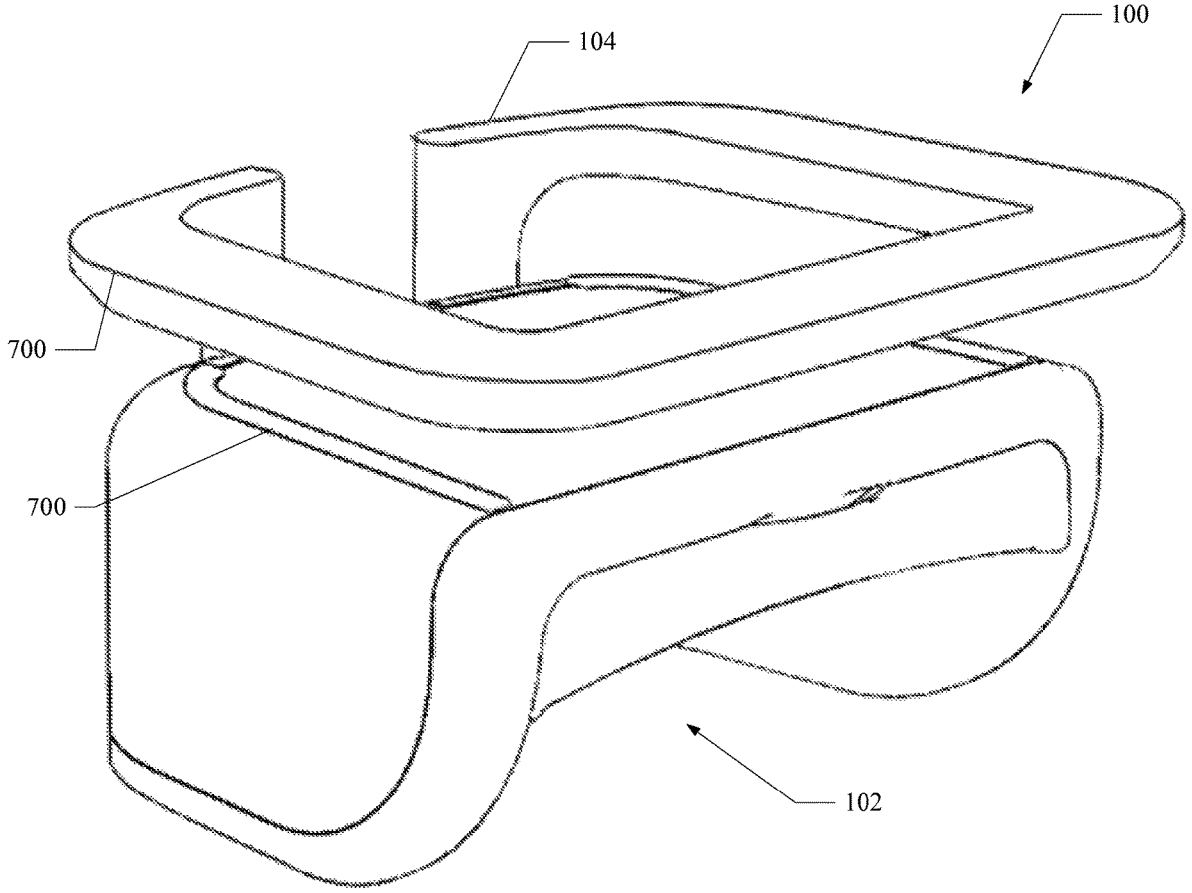
FIG. 7 is a perspective view of an embodiment of a child seat, inverted to show grip features.

In accordance with an embodiment depicted in FIG. 7, the base component 104 and the seat 102 include one or more grips 700. The grips 700 are exterior components of a material with a high friction coefficient when placed on a table, chair, or other surface commonly used for the child seat 100. For example, the grips 700 can be a layer of rubber or other material secured to the seat component 102 and base component 104 by an adhesive or another bonding method. As shown in the illustrated child seat 100, the grips 700 can be positioned on the base component 104 as well as the outer shell 302 located on the bottom of the seat component 102. The grips 700 serve two purposes; they keep the child seat 100 from sliding from wherever it is placed (whether it is on a chair, table, or floor) and they protect the surface on which the child seat 100 is placed from scratches. In other embodiments, the grips 700 are formed from silicone rubber or any other suitable material that provides security by resisting movement with high friction. In an embodiment, the grips 700 are positioned on the bottom of the base component 104 so that it will not slip or scratch when placed on a smooth floor, table top or hard chair surface. In an embodiment, the grips 700 are included on the top of the base component 104 and bottom portion of the seat component 102 so when the child seat 100 is clamped to the top of a table surface, the grips 700 contact the top and bottom of the table surface, preventing the child seat 100 from damaging the table or slipping off the table.

Figure 8A:
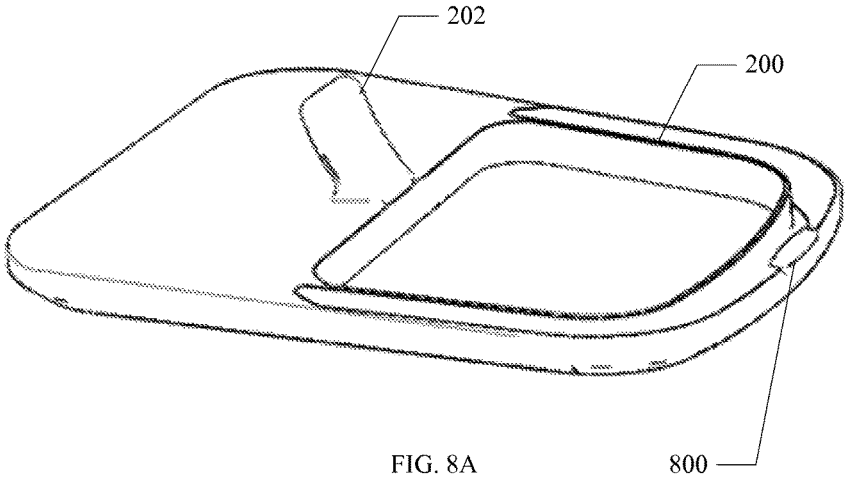
FIGS. 8A and 8B depict views of an embodiment of a tray with restraining bar.
Figure 8B:
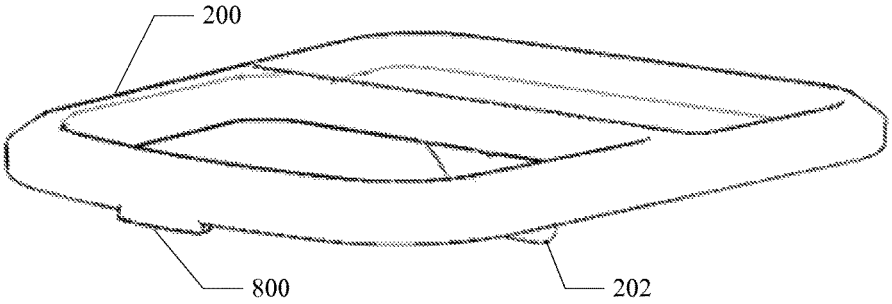

FIGS. 8A and 8B illustrate an embodiment of the tray 200 which can be snapped in place onto the child seat 100. When in use, the tray 200 is attached to the arms 108 and back support 106 of the inner shell 300 and extends in front of the child when seated in the child seat 100. The tray 200 is designed to position food within easy reach of the child and to contain the spillage of food and other substances, reducing the mess on the floor or on other areas of the child seat 100. The tray 200 can include a built in restraining bar 202 which can be a rectangular projection downward from the center of the tray 200 to provide an extra safety measure for children who may squirm or swing their legs. The restraining bar 202 can prevent a child from sliding under the tray 200 and out of the seat component 102. In embodiments, the tray 200 is seated securely on the top of the inner shell 300 and can be easily removed by lifting the tab 800 at the back of the tray 200 and pulling up. In other embodiments, the removable tray 200 could be slid into slotted grooves from the front of the child seat 100 or attached to the bottom of the child seat 100 for added security. In alternate embodiments, the removable tray 200 could be made of two pieces allowing the eating surface to be separated from the restraining bar 202 and remainder of the tray and washed separately. The removable tray 100 could also pivot around the child chair to remove the child from the chair without removing the tray each time. The removable tray 200 can be washed while attached to the seat component 102 or if removed, it can be washed in the sink or in a dishwasher.

Figure 9:
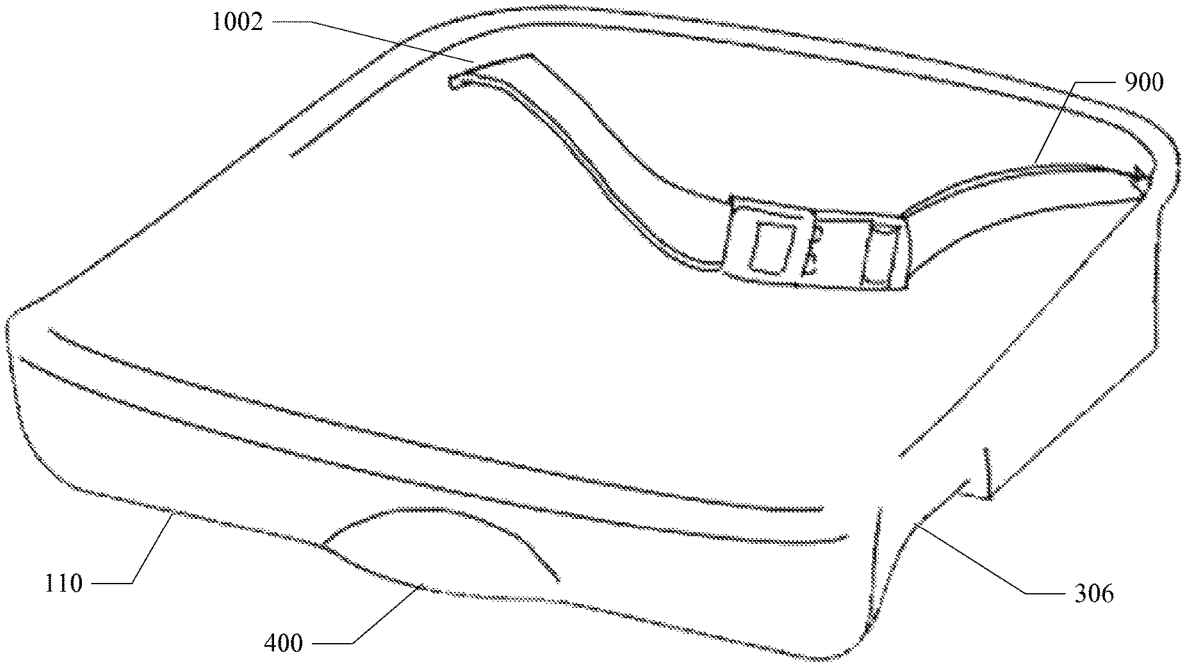
FIG. 9 depicts an embodiment of a seat pan, including a restraint belt.

Turning now to FIG. 9, in an embodiment, the child seat 100 includes a restraint belt 900. This optional restraint belt 900 offers added protection and security, preventing children from slipping or falling out of the child seat 100 by threading through slots 902 positioned in the seat bottom 501. In another embodiment, the restraint belt 900 can be coupled to the removable seat pan 110. Here, the seat pan 110 includes one or more angled slots 902 on the two corners that are positioned proximate to the back support 106 of the seat component 102 for this purpose. The restraint belt 900 can be threaded through the angled slots 902 and attached to the back of the seat pan 110 through Velcro, snaps or other attachment means. When the seat pan 110 is removed, the restraint belt 900 comes along with it, making the belt easy to rinse or clean. In embodiments, the restraint belt 900 is detachable from the seat pan 110, and can be cleaned separately, simplifying the cleaning process and making it possible for the belt 900 to be laundered or run through a dishwashing machine cycle. Additionally, the slots 902 on the seat pan 110 can be angled to help prevent food and spills from entering the slots. In another embodiment, the restraint belt 900 is attached to the seat bottom 501, seat back 106, or inner shell 300. The restraint belt 900 can be threaded through slots 902 in the seat pan 110 when the seat pan 110 is in place in the child seat 100.

Figure 10:
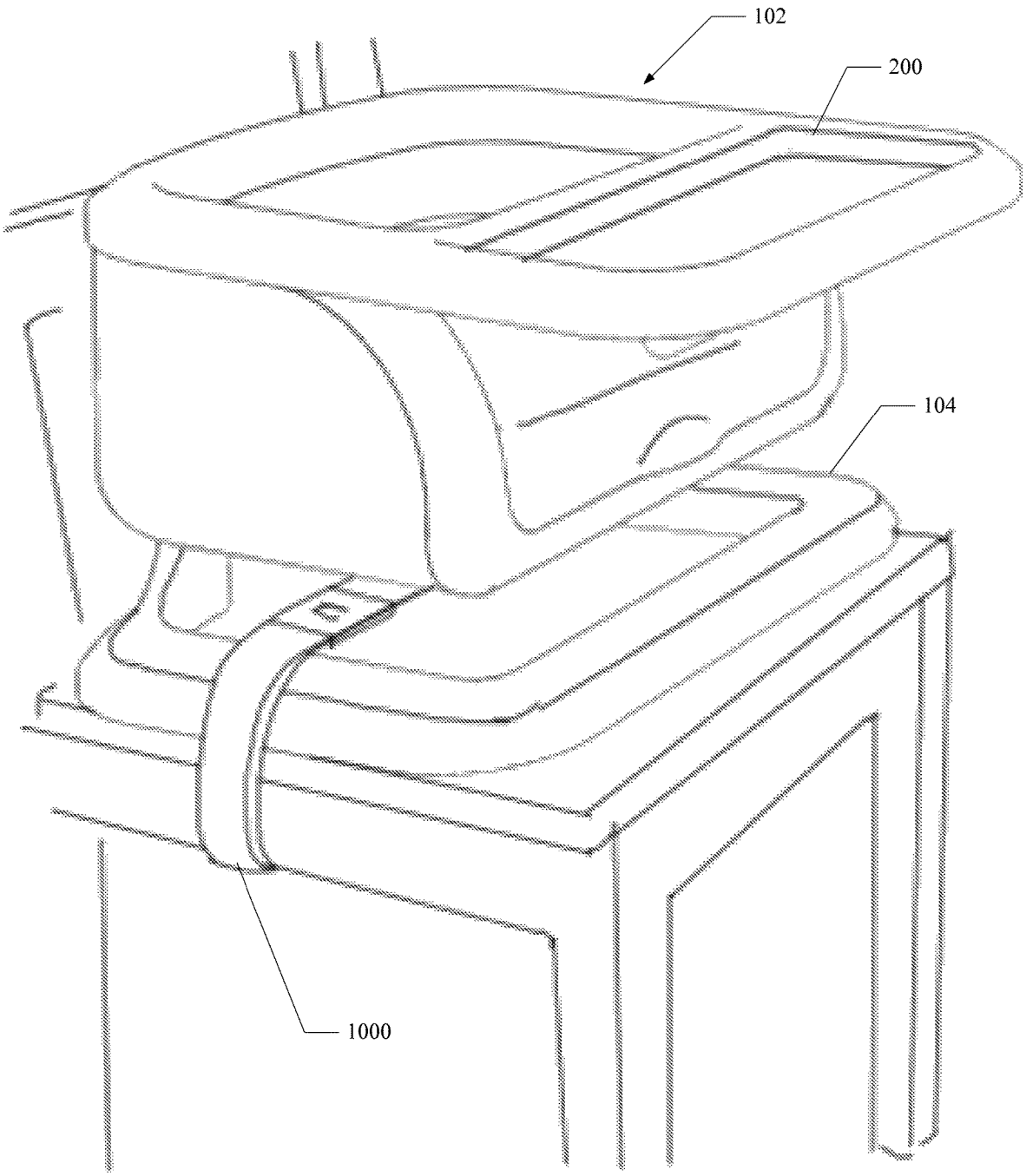
FIG. 10 depicts a perspective view of an embodiment of a child seat attached to a chair, and including the seat pan, tray, and restraint belts.

In the embodiment depicted in FIG. 10, the seat pan 110, and tray 200 are positioned on the child seat 100, and a strap 1000 is used to secure the base component 104 of the child seat 100 to a typical chair. This embodiment illustrates how the strap 1000 can be wrapped around the base component 104 and the seat of a typical chair when the child seat is placed on a chair. Wrapping the strap 1000 around chair stabilizes the child seat 100, preventing it from tipping, falling or sliding off the chair. FIG. 10 also illustrates an embodiment designed to protect the safety and support the needs of a toddler when the various optional components (restraint belt 1000, seat pan 110, and tray 200) are attached.

The height adjustment mechanism 304 also allows for more variability in meeting the needs and size of growing toddlers. When the base component 104 of this embodiment is placed on a chair as shown in FIG. 10, the seat component 102 can be raised or lowered based upon the height of the child, the chair, and the table. This versatility allows the parent to place his child at the same height as the rest of the family during dinner or any other height they desire within a predetermined range. This is also true when the child seat 100 is placed on the floor. Also, with a continuously growing child, predetermined heights may be less than ideal for all children, or alternatively may be ideal for only short periods of time, resulting in the child being either too high or too low in the seat component 102 relative to the floor or other surface. The continuous mechanism as disclosed mitigates this problem.

Figure 11:
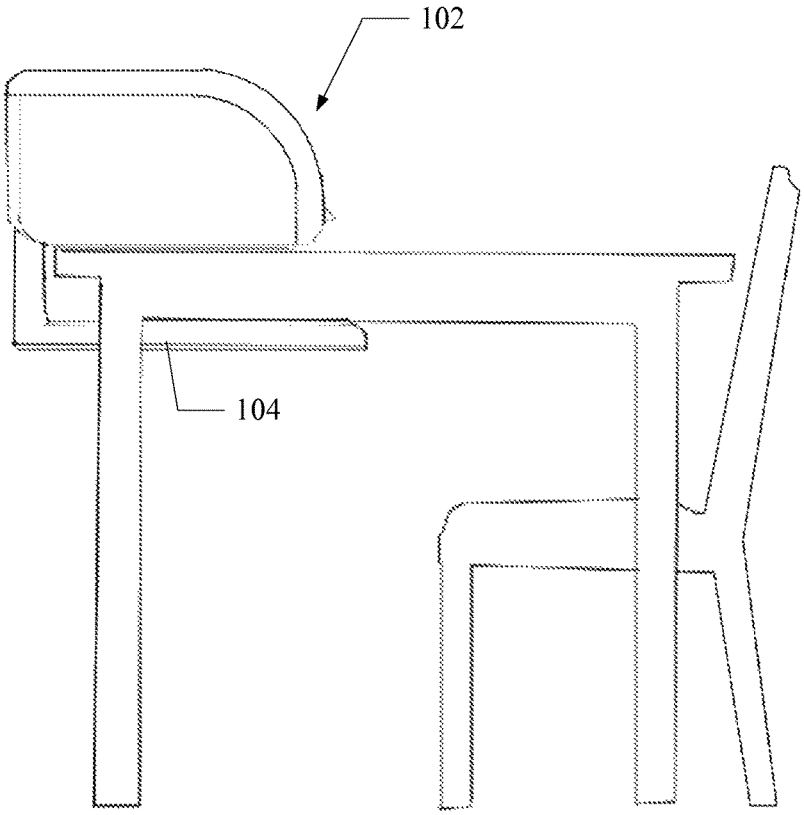
FIG. 11 depict an embodiment of a child seat attached to a table.

FIG. 11 illustrates an embodiment where the child seat 100 is attached to a table top. Here, FIG. 11 depicts the child seat 100 without the tray 200. The parent sets the child seat 100 on the table with the seat component 102 resting on the surface of the table and the base component 104 positioned underneath the table top. The height adjustment mechanism 304 is engaged to move the base component 104 in a snug manner with the table top. In one embodiment, this is accomplished by depressing the buttons 600 and pushing the base component 104 up into contact with the table. The parent then releases the buttons 600 locking the child seat into place. The height adjustment mechanism 304 serves as a clamp to secure the child seat 100 to the table. Once the child seat 100 is securely attached to a table's ledge and on top of the table, the child can be positioned in the child seat 100 and the optional tray 200 can then be attached. In another embodiment, grips 700 on the base component 104 and seat component 102 help secure the child seat 100 to the table top.

As shown in FIG. 11, the configuration of the child seat 100 positions the weight of the child and child seat 100 directly over the table. Positioning the child on top of the table, as opposed to cantilevered from the side of the table, reduces the potential for the table to tip or overturn and therefore increases safety of the child. Furthermore, even without the clamping action of the height adjustment mechanism 304, positioning the seat component 102 and child on top of the table reduces risk of the child falling.

Figure 12:
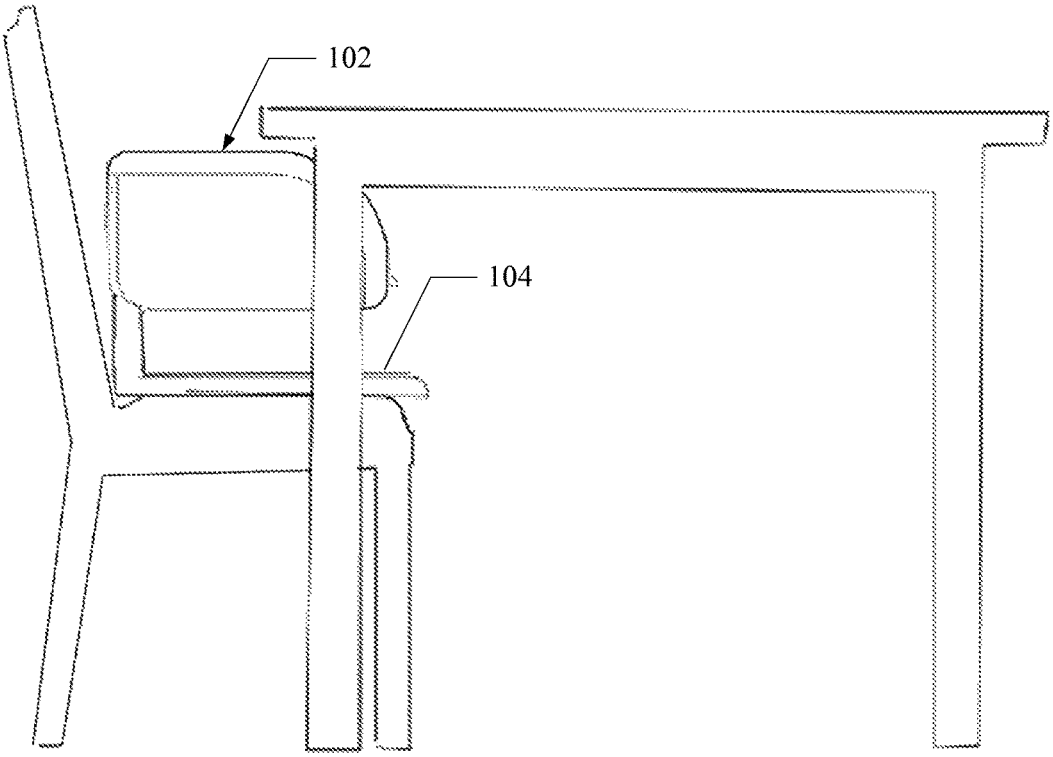
FIG. 12 depicts an embodiment of a child seat where the child seat is placed on a chair.

FIG. 12 illustrates the child seat 100 placed on a chair. FIG. 12 depicts the child seat 100 without the tray 200. When the child seat 100 is placed on a chair, the seat pan 110 can be attached or removed to raise or lower the seat component 102 relative to the table, depending on the needs of the child. A strap 1000 can also be attached to secure the base component 104 of the child seat 100 to the chair, as seen earlier in FIG. 10. Using the height adjustment mechanism 304, the child seat 100 can be adjusted to an optimal height for the table. The optional tray 200 can then be attached.

Additional configurations not illustrated can include removing the tray 200, but retaining the seat pan 110 and restraint belt 900 to allow for a larger sitting area by older children. In a configuration for older children, the tray 200 and seat pan 110 can both be removed, but the strap 1000 left attached to provide for extra security against possible tipping or falling accidents. Any combination of these features can be used to customize the child seat 100 for the needs of the child.

While embodiments have been shown and described, it will be appreciated by those skilled in the art that changes may be made in those embodiments without departing from the principles and spirit of the devices and methods. What has been described above includes examples of aspects of the claimed subject matter. It is, of course, not possible to describe every conceivable combination of components or methodologies for purposes of describing the claimed subject matter, but one of ordinary skill in the art may recognize that many further combinations and permutations of the disclosed subject matter are possible. Accordingly, the disclosed subject matter is intended to embrace all such alterations, modifications, and variations that fall within the spirit and scope of the appended claims. Furthermore, to the extent that the terms "includes," "has" or "having," or variations in form thereof are used in either the detailed description or the claims, such terms are intended to be inclusive in a manner similar to the term "comprising" as "comprising" is interpreted when employed as a transitional word in a claim.

I claim:

1. A child seat, comprising:

a seat component comprising:

a back support, arms, and a seat bottom; and a removable seat pan that rests on top of the seat bottom, wherein upon removal of the seat pan from the seat component, the seat pan lacks significant support for a child; and wherein the seat bottom is shaped to support the child in a sitting position when the seat pan has been removed from the child seat; and a removable restraining mechanism that secures the child in the seat component and is capable of securing the child both when the removable seat pan is resting on the seat bottom and when the removable seat pan has been removed from the child seat, wherein the restraining mechanism includes a belt and the seat pan includes at least one slot to allow the belt to pass through the seat pan to secure the child to the child seat, and the belt is attached to the seat component and the belt is removed from the at least one slot when the seat pan is removed from the seat component.

2. The child seat of claim 1, wherein the seat pan is complementary in shape to the seat bottom.

3. The child seat of claim 1, wherein the seat pan has a top surface that is substantially concave.

4. The child seat of claim 1, wherein the seat pan is substantially rigid.

5. The child seat of claim 1, further comprising:

a detachable tray that is adapted to be attached to the seat component; and a restraining bar connected to the tray that extends downward from the tray.

6. The child seat of claim 1, further comprising a base component connected to the seat component and supporting the child seat on a surface below.

7. The child seat of claim 6, further comprising a strap that secures the child seat to a surface beneath the base component.

8. A child seat, comprising:

a seat component comprising:

a seat bottom shaped to support a child in a sitting position, a back support connected to the seat bottom, and a pair of arm supports connected to the seat bottom; and a removable seat pan that rests on top of the seat bottom; and at least one slot in the removable seat pan, the at least one slot configured to allow a belt attached to the seat component to pass through the seat pan, wherein the seat bottom is shaped to support a child in a sitting position when the seat pan has removed from the child seat.

9. The child seat of claim 8, wherein the seat pan is semi-rigid.

10. The child seat of claim 8, wherein the seat pan is rigid.

11. The child seat of claim 8, the seat pan is made of injection molded high density organic polymer.

12. The child seat of claim 8, wherein a top surface of the seat pan is concave and configured to retain debris within the seat pan.

13. A child seat, comprising:

a seat component comprising:

a seat bottom shaped to support a child in a sitting position, a back support connected to the seat bottom, and a pair of arm supports connected to the seat bottom; and a removable, monolithic seat pan that rests on top of the seat bottom, wherein the seat pan is substantially rigid and is contoured to retain debris; and at least one slot in the removable seat pan, the at least one slot configured to allow a belt attached to the seat component to pass through the seat pan, wherein the seat bottom is shaped to support a child in a sitting position when the seat pan has removed from the child seat.

* * * * *